United States Patent [19]

LeTourneau

[11] 4,200,938

[45] May 6, 1980

[54] ADJUSTABLE PANT LEG SYSTEM

[76] Inventor: Thomas R. LeTourneau, 820 Brook St., Elgin, Ill. 60120

[21] Appl. No.: 844,604

[22] Filed: Oct. 25, 1977

[51] Int. Cl.[2] ..... A41D 27/10
[52] U.S. Cl. ..... 2/269
[58] Field of Search ..... 2/269, 211, 275, 243; 33/2 H, 137 R, 2 R, 232, 108

[56] References Cited

U.S. PATENT DOCUMENTS

| | | | |
|---|---|---|---|
| 2,414,429 | 1/1947 | Solomon | 2/269 |
| 2,524,814 | 10/1950 | Leat | 2/269 |
| 3,230,545 | 1/1966 | Galley | 2/74 |
| 3,601,817 | 8/1971 | Abrams | 2/269 |
| 3,881,041 | 4/1975 | Glienke | 2/269 |

FOREIGN PATENT DOCUMENTS

| | | | |
|---|---|---|---|
| 1212012 | 3/1966 | Fed. Rep. of Germany | 2/269 |

*Primary Examiner*—Thomas F. Callaghan
*Assistant Examiner*—Doris L. Troutman
*Attorney, Agent, or Firm*—Robert L. Lindgren

[57] ABSTRACT

An adjustable pant leg system includes a pair of trouser legs having a row of synthetic hook and loop material affixed to an inner surface at the bottom edge portion of the trouser legs. A plurality of rows of synthetic hook and loop material is also spaced equally on the inside of the trouser legs along a bottom portion of its length. The synthetic hook and loop material affixed at the edge portion is folded inwardly and upwardly along the length on the inside of the trouser legs for engagement with one of the plurality of rows of synthetic hook and loop material to form the legs of a desired length.

8 Claims, 8 Drawing Figures

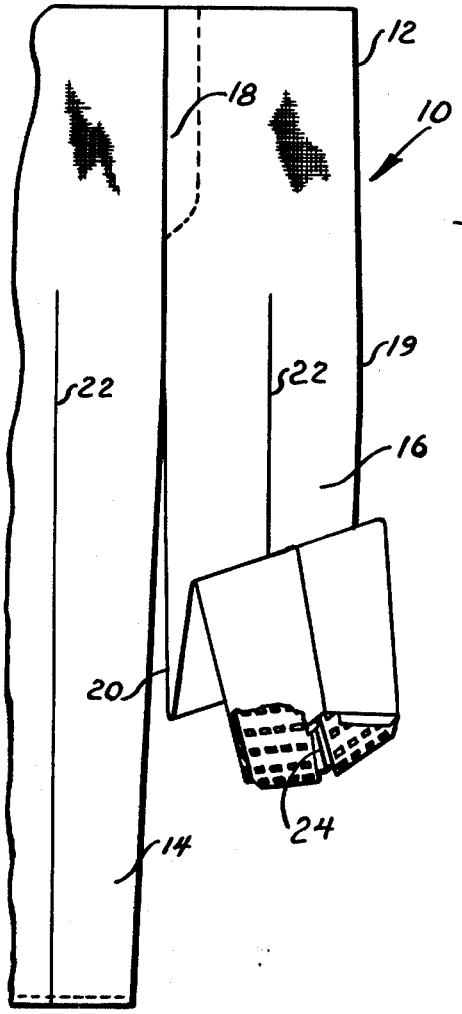
Fig. 1
Fig 6
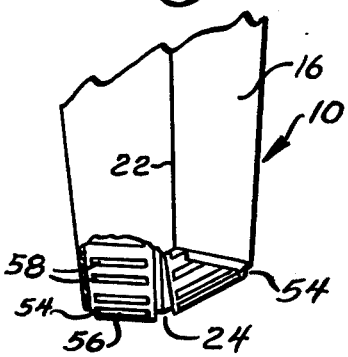
Fig. 3
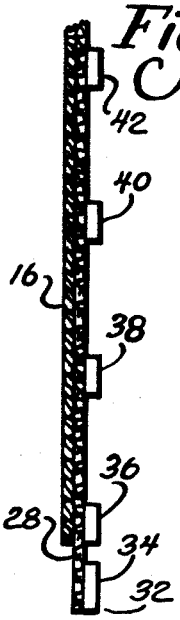
Fig. 4
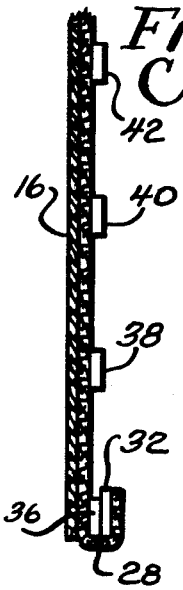
Fig. 5
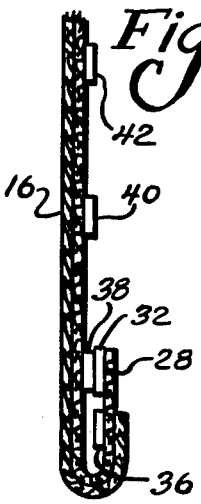
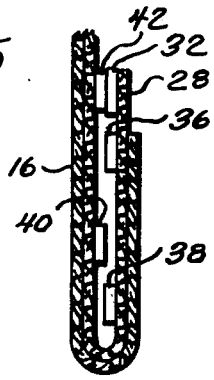
Fig. 5a

ADJUSTABLE PANT LEG SYSTEM

BACKGROUND OF THE INVENTION

This invention relates generally to garment constructions and more particularly, it relates to an adjustable pant leg system for use in trouser legs to permit ready adjustment and/or readjustment in the length of the trouser legs for accommodating the changes in size of a user or the different lengths required by various users without the need of sewing or stitching. The invention has particular application in tuxedo rental facilities and the like in which the length of the legs in the trousers to be rented can be adjusted easily and quickly to fit the different customers.

Heretofore, the lengths in the trouser legs were adjusted to fit the different customers in rental facilities by unstitching and restitching of the trouser legs with the use of the sewing machine. This was not only a slow and time-consuming process but it required the services of a skilled seamstress or tailor which increased labor costs. It would, therefore, be desirable to provide an adjustable pant leg system wherein the length of the pants legs can be easily adjusted without the requirements of measuring and sewing or stitching, thereby eliminating excessive labor costs and time-consuming operations.

SUMMARY OF THE INVENTION

Accordingly, it is a general object of the present invention to provide an adjustable pant leg system which permits ready adjustments in the length of the trouser legs without any sewing or stitching operation required.

It is an object of the present invention to provide an adjustable pant leg system wherein the length of the trouser leg may be readily shortened or lengthened by a user to accommodate his change in size or a different desired length thereby increasing the wearing life of the trousers.

It is another object of the present invention to provide an adjustable pant leg system wherein reference numeral designations corresponding to pre-determined outseam lengths are affixed on the inside of the trouser legs for eliminating the necessity of measurements.

It is still another object of the present invention to provide a new and improved adjustable pant leg system which is relatively inexpensive to manufacture and the amount of time required to make an adjustment in the length of the trouser legs is substantially reduced.

It is still another object of the present invention to provide a method of forming adjustable pant legs which is very quick and easy.

In accordance with these aims and objectives, the instant invention is concerned with the provision of an adjustable pant leg system which includes a pair of trouser legs having a row of synthetic hook and loop material material affixed to an inner surface at the bottom edge portion of the trouser legs. A plurality of rows of synthetic hook and loop material material is also spaced equally on the inside of the trouser legs along a bottom portion of its length. The synthetic material hook and loop material material affixed at the edge portion is folded inwardly and upwardly along the length on the inside of the trouser legs for engagement of one plurality of rows of synthetic hook and loop material material to form the legs of a desired length so that the effective lengths of the trouser legs are varied by upward and downward adjustment of the synthetic hook and loop material material at the edge portion with respect to the plurality of rows of synthetic hook and loop material material.

A center line or mark can be attached to a fabric lining along the outseam length on the inside of the trouser legs and the bottom edge of the fabric lining can be provided with a centering notch for facilitating alignment of the synthetic hook and loop material material. In addition, reference numeral designations corresponding to pre-determined outseam lengths are affixed adjacent to the center mark for eliminating the necessity of any measurements.

The instant invention is particularly efficient and economical in providing a new and improved adjustable pant leg system since the lengths of the trouser legs desired can be formed very easily and rapidly. Further, the adjustable pant legs system in the present invention is relatively simple in construction and inexpensive to manufacture.

BRIEF DESCRIPTION OF THE DRAWINGS

These and other objects and advantages of the present invention will become more fully apparent from the following detailed description when read in conjunction with the accompanying drawings wherein:

FIG. 1 is a front elevational view of the front of a fragment of a pair of trousers, according to the present invention;

FIG. 3 is a vertical cross-sectional view of the trouser leg taken along the lines 3—3 of FIG. 2;

FIG. 4 is a view similar to FIG. 3 but showing the end of the trouser leg turned in for cleaning and initial pressing;

FIG. 5 is a vertical cross-sectional view of the trouser leg showing the end thereof turned in to form a given length;

FIG. 5*a* is a view similar to FIG. 5 but showing the end of the trouser leg turned in to form a different length; and FIG. 6 is a front elevational view of a portion of a trouser leg showing another embodiment of the present invention.

DESCRIPTION OF THE PREFERRED EMBODIMENTS

Figure 2:
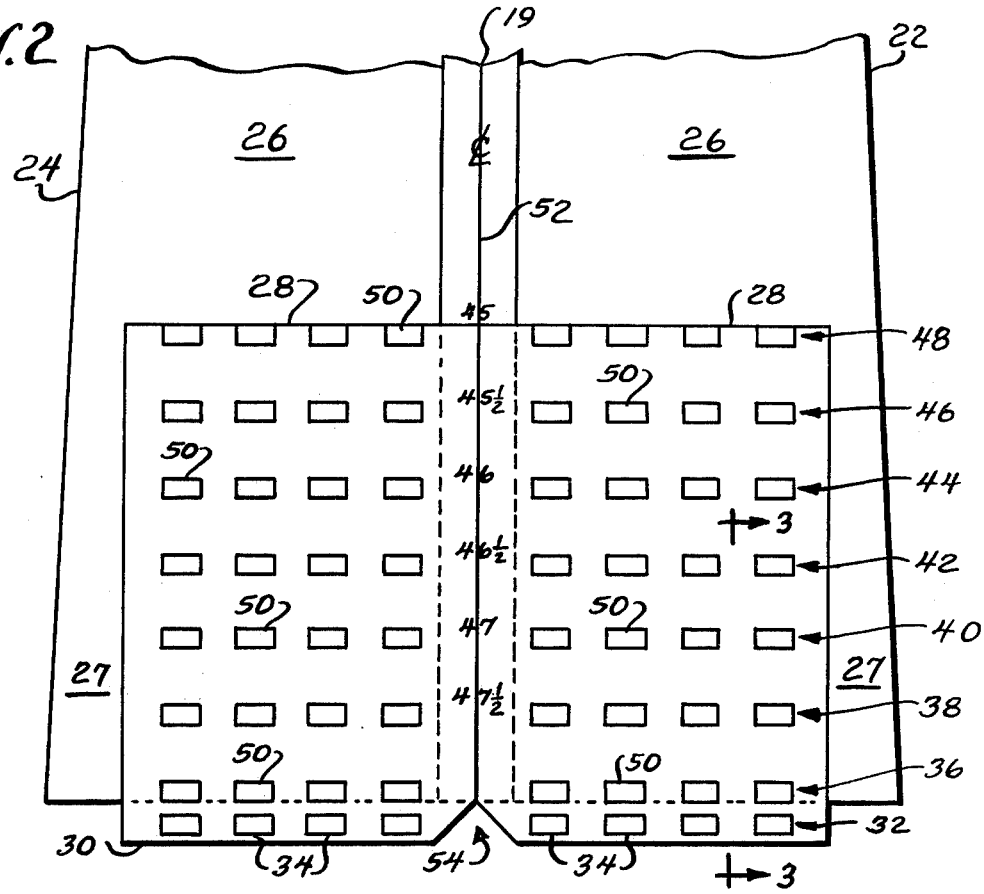
FIG. 2 is a view similar to FIG 2*a* but showing more details of the trouser leg.

Referring now in detail to the various views of the drawings, there is shown in FIG. 1 a fragment of a pair of fabric trousers 10 illustrating one embodiment of the present invention. The trousers 10 has a waist portion 12, two legs 14, 16 and a fly portion 18. As is usual, each of the trouser legs 14, 16 may be constructed of suitably formed sections of fabric joined together and forming at their junctures an outseam 19 and an inseam 20. The legs 14, 16 are provided with front creases 22 and rear creases 24 formed respectively therein. The legs are made of a pre-determined length for accommodating the different leg sizes of various users. While the present invention is being described in connection with a pair of trousers, it is to be clearly understood that the invention is also applicable to skirts, dresses, slacks, coats, sleeves and the like.

Figure 2A:
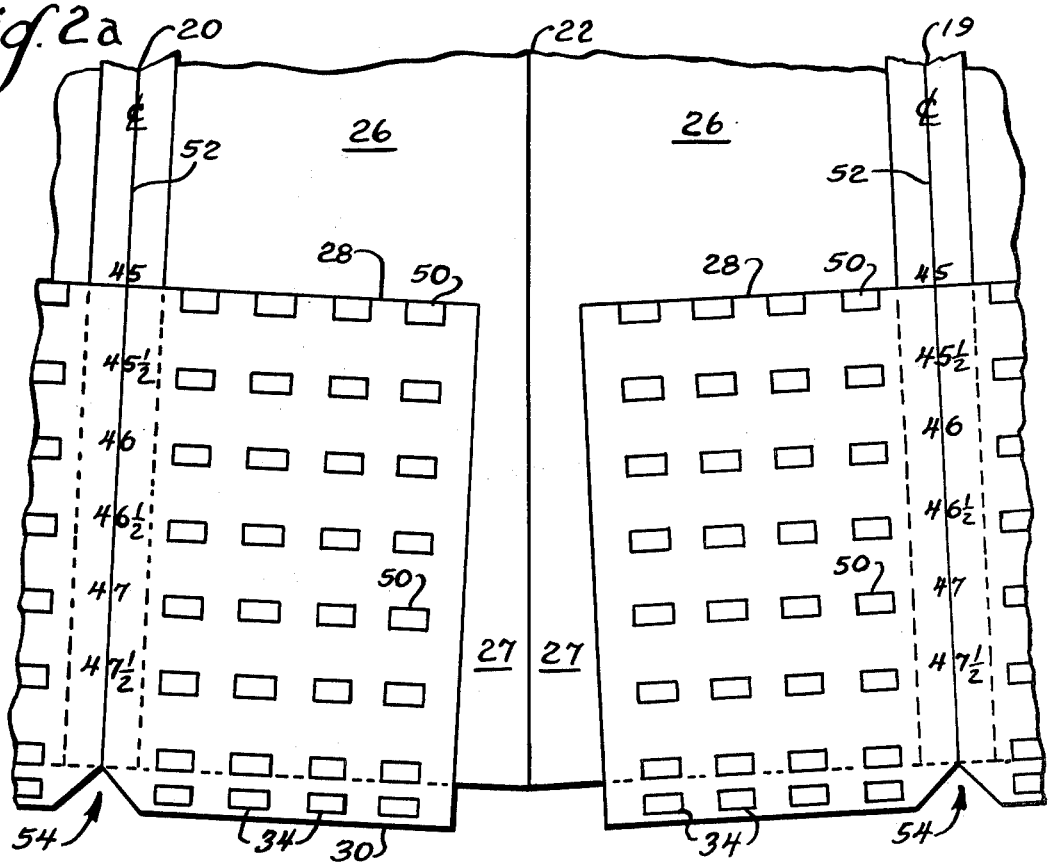
FIG. 2*a* is an enlarged plan view of the inside of the trouser leg shown in FIG. 1.

In accordance with the invention, each of the legs 14, 16 have affixed with a suitable adhesive or otherwise attached to its inner surface 26, as viewed in FIGS. 2, 2*a* and 3, two rectangularly-shaped sections or layers of fabric lining or backing 28 made of any suitable material such as nylon and the like. On the bottom edge 30 of the fabric lining 28 extending below the fabric material of the leg of the trousers, there is affixed adhesively or otherwise attached circumferentially to the surface of the fabric lining 28 a horizontal row 32 of synthetic hook and loop material material. The horizontal row 32 is formed of a plurality of rectangular segments or portions 34. These segments 34 of synthetic hook and loop material material comprise tiny resilient hook sections. One form of synthetic hook and loop material that may be used is Velcro which is sold under the trademark synthetic hook and loop material which is described and illustrated in U.S. Pat. No. 2,717,437. Each of the segments 34 are approximately ¼ inch in height and ½ inch in width which are spaced a ½ inch apart. Of course, these dimensions are subject to variations, but are merely assumed for convenience of illustration.

A plurality of horizontal rows 36–48 of material are further affixed with a suitable adhesive or otherwise attached circumferentially to the surface of the fabric lining 28 along a bottom portion of its length. It should be apparent to those skilled in the art that any desired number of rows, more or less than what is shown, can be utilized. The horizontal rows 36–48 are formed of a plurality of a rectangular segments or portions 50. These segments 50 of synthetic hook and loop material material comprise finely woven loop sections. Each of the rows 36–48 are disposed parallel to each other and to the horizontal row 32, each of the adjacent rows 36–48 being spaced approximately 1 inch apart. All of the segments 50 are the same size as the segments 34 and are in vertical alignment therewith.

A center line or mark 52 arranged along the outseam length of the trousers is woven or otherwise affixed to the fabric lining 28 in a color contrasting to the color of the lining. A centering notch 54 is also formed in the bottom edge 30 by the two adjoining layers of the fabric lining 28. The mark 52 and the notch 54 defining alignment means permit easy alignment of the segments 34 with respect to the segments 50 during folding as will be explained hereinafter. The fabric lining 28 is labeled with reference numeral designations "45" through "47½", which correspond to particular or pre-calibrated outseam lengths of the trousers, adjacent the center line 52 thereby eliminating any need for measurements.

In FIG. 4, the hook sections 34 on the horizontal row 32 are affixed to the loop sections 50 on the row 36. This is done each time during laundering and pressing of the trousers at the cleaners so as to prevent the hook sections of synthetic hook and loop material material from snagging other materials and damaging the trousers. Since the trousers are always cleaned in the full length position in this manner and prior to adjustment for a particular user, soiled rings or creases around the bottom extremity of the trouser fabric is eliminated.

In order to form a cuff structure on the inside of the trouser leg, a portion of the bottom extremity of the trouser leg including the bottom edge 30 of the fabric lining 28 with the segments 34 or hook sections is manually turned or folded inwardly and upwardly along the length on the inside of the trouser leg to the position shown in FIG. 5 of the drawings. Accordingly, the hook sections 34 of the synthetic hook and loop material material in the horizontal row 32 may be releaseably attached for engagement with the synthetic hook and loop material material on the segments 50 or loop sections of the row 38. By merely pressing the hook sections 34 of the synthetic hook and loop material material into the loop sections 50 of the synthetic hook and loop material material, the propoer length of the leg of the trouser can be made almost instantaneously for initial wearing. As can be seen, the notch 54 facilitates alignment of the segments 34 with the segments 50 along the center mark 52 without any required measurements due to the labeled reference numeral designations corresponding to the outseam lengths.

As can be seen in FIG. 2*a*, the hook sections 34 and the loop sections 50 are disposed so as to completely encircle the fabric lining 28, but do not contact or abut the creases 22, 24 of the trousers. Likewise, the spacing of the hook sections 34 and the loop sections 50 should be slightly wider on either side of the center line 52 on the outseam 19 and inseam 20 as seen in FIG. 2. Further, the plurality of rows 36–48 are spaced vertically so that each row is positioned between two opposing rows (FIG. 5*a*) during the folding operation thereby reducing the bulk of the folded fabric and avoiding a double thickness of the loop sections 50 at the bottom portion of the trouser leg. All of this facilitates also the making of sharper creases in the front, back and bottom of the legs of the trousers. In addition, this allows spaces 27 for storing any excess material that may exist due to a flared leg, i.e., one which is wider at the bottom than at the top. It is to be understood that pressing with a hot iron will be required after each adjustment to provide sharp creases at the bottom of the legs.

When because of growth in size of the user, a difference in heel height, or due to a different customer size in the case of rental facilities, it becomes necessary to lengthen or shorten the trouser legs. This can be done simply and easily by pulling the bottom edge 30 of the fabric lining 28 containing the hook sections 34 away from the loop sections 50 whereupon the edge 30 is detached and can then be subsequently moved upwardly or downwardly along the length on the inside of the trouser leg to a desired point thereon. Next, the segments 34 and the segments 50 can be pressed again together to form a new cuff length for accommodating the size of the user. In FIG. 5*a*, there is shown the segments 34 of the row 32 attached releaseably to the segments 50 of the row 42 to form a new shorter length of the trouser leg than the length shown in FIG. 5.

In another embodiment of the present invention shown in FIG. 6 of the drawings, the horizontal row 32 of synthetic hook and loop material material on the bottom edge 30 of the fabric lining 28 is formed as a relatively narrow continuous band or strip 56. Further, each of the plurality of rows 36–48 of synthetic hook and loop material material are also made as a relatively narrow continuous band or strip 58. Each of the strips 58 are positioned parallel to each other and to the strip 56. Aside from this, the operation and function of the strips 56, 58 are identical to the rectangular segments 34, 50 described previously above.

The continuous strips 56, 58 provide a stronger connection therebetween than the rectangular segments 24, 50. However, it has been experienced in practice that the segments permit a sufficient and adequate engagement and yet gives the advantages of using less synthetic hook and loop material material thus reducing cost and weight and permitting greater flexibility.

From the foregoing detailed description, it can be thus seen that the present invention provides a new and improved adjustable pant leg system which permits ready adjustment in the length of the trouser legs in which no sewing operation is required. Further, due to the precalibrated reference designations along the outseam length the necessity of measurement of the trouser material to form cuffs in an accurate manner has been entirely eliminated. In addition, the time required to perform the operation has been significantly reduced and the degree of skill of labor has likewise been materially decreased.

While there has been illustrated and described what is at present to be preferred embodiments of the present invention, it will be understood by those skilled in the art that various changes and modifications may be made, and equivalents may be substituted for element thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. An adjustable pant leg system comprising:

trousers having a pair of legs;

a strip provided with first interengageable means applied to the inside of each trouser leg adjacent the lower edge extremity of each trouser leg and disposed generally symmetrically about the vertical axis of each leg;

second interengageable means applied without stitching or seams to the inside of each trouser leg adjacent the first interengageable means and extending vertically upwardly therefrom inside of each trouser leg;

orientation means on the interengageable means for positioning without stitching or seams the interengageable means in pre-selected orientation with respect to the vertical axis of each trouser leg;

calibration means on the second interengageable means disposed without stitching or seams in preselected relationship with the axis of each trouser leg when disposed in selected orientation therewith;

the calibration means including plural measuring indicia disposed in pre-arranged relationship with the vertical axes of the respective trouser legs to facilitate precise repeated and selective adjustment of trouser leg length without stitching or seams by engaging the interengageable means of the strip in selected relationship with the calibration means to provide a seamless system for extending or shortening trouser legs.

2. The system of claim 1 wherein the interengageable means comprise synthetic hook and loop elements facilitating repeated separation and interengagement in the adjustment of trouser by length.

3. The system of claim 2 wherein the interengageable means are adhesively applied directly to the inside of the respective trouser legs to enhance the seamless appearance of the system.

4. The system of claim 2 wherein the interengageable means are applied only to portions of inside trouser leg circumference to facilitate storage of excess trouser leg fabric or flared legs during adjustment and pressing.

5. The system of claim 2, wherein the orientation means are used to selectively orient the interengageable means in precise relation to at least one vertical trouser seam of each leg and the calibration means are disposed at a pre-determined distance from a selected point on the seam space opposite the edge extremity of the respective legs.

6. The system of claim 2, wherein one of the synthetic hook and loop elements is disposed axially outwardly and beyond the lower edge extremity of each trouser leg to facilitate cleaning and pressing operations.

7. A method for repeatedly adjusting the leg length of trousers comprising the steps of:

seamlessly applying interengageable means to the inside of the trouser legs adjacent the lower edge extremities thereof;

selectively orienting the interengageable means relative to at least one leg seam of each leg;

calibrating the interengageable means relative to a preselected point on the leg seams; and folding the leg edge extremity inwardly and engaging the interengageable means in the selective adjustment of leg length.

8. The method of claim 7 wherein the interengageable means are applied to only a portion of the inside trouser leg circumference to facilitate the inward folding of the excess material of flared trouser legs and the pressing in place thereof after adjustment in a manner avoiding the appearance of lumps or bulges of excess material.

* * * * *